United States Patent [19]

Mabus

[11] 4,127,219

[45] Nov. 28, 1978

[54] NEEDLE DISPENSER

[76] Inventor: Richard C. Mabus, 46 Mary Dr., Towaco, N.J. 07082

[21] Appl. No.: 754,590

[22] Filed: Dec. 27, 1976

[51] Int. Cl.[2] ..... A47F 1/04

[52] U.S. Cl. ..... 221/303; 206/380; 51/317; 223/109 R

[58] Field of Search ..... 206/379–383, 206/443, 366, 367, 369, 370; 221/303, 304, 312 C, 312 R, 69, 259; 223/109, 109 R, 108, 106; 51/152, 6, 317, 16; 220/DIG. 14, 31

[56] References Cited

U.S. PATENT DOCUMENTS

| | | | |
|---|---|---|---|
| 1,696,080 | 12/1928 | Draggie | 221/312 R |
| 1,744,195 | 1/1950 | Alland | 221/312 R |
| 2,460,657 | 2/1949 | Robinson | 51/317 |
| 3,142,422 | 7/1964 | Mojonnier | 220/DIG. 14 |
| 3,212,670 | 10/1965 | Tint et al. | 221/312 R |
| 3,706,393 | 12/1972 | Curtis et al. | 220/DIG. 31 |

FOREIGN PATENT DOCUMENTS

| | | | |
|---|---|---|---|
| 1,153,454 | 3/1958 | France | 206/380 |

*Primary Examiner*—Robert B. Reeves
*Assistant Examiner*—H. Grant Skaggs
*Attorney, Agent, or Firm*—Jack Matalon

[57] ABSTRACT

A needle dispenser comprising a tubular body whose walls define a cavity therein for storage of needles, said body terminating in a first end which is sealed at its extremity and terminating at a second end in a substantially convex surface, said surface containing a substantially centrally located, substantially-circular aperture in communication with said cavity, said aperture having a diameter in excess of the maximum diameter of the greatest-diameter needles to be stored in said cavity. Preferably the cavity contains a plurality (e.g. 3–5) of B—B shot which prevents the needles from readily falling out of the aperture.

9 Claims, 2 Drawing Figures

NEEDLE DISPENSER

This invention comprises a needle dispenser. This dispenser comprises a tubular body whose walls define a cavity therein for storage of needles, said body terminating in a first end which is sealed at its extremity and terminating at a second end in a substantially convex surface, said surface containing a substantially centrally located, substantially circular aperture in communication with said cavity, said aperture having a diameter in excess of the maximum diameter of the greatest-diameter needles to be stored in said cavity.

Preferably the needle dispenser contains a plurality (e.g. 3–5) of B—B shot (i.e. spherical pellets of 0.17–0.18 inch diameter) or other solid pellets of similar shape and diameter. The B—B shot serves two useful functions: (a) B—B shot prevents the needle from freely falling out of the dispenser; that is, when the dispenser is flipped so that the aperture is at an acute or right angle to the plane of the ground, a needle will emerge only partially through the aperture (e.g. one-fourth–one-half of the length of the needle will emerge) and the remainder of the needle will be frictionally held within the cavity by the contact of the B—B shot with the emerged needle. Thereafter, the needle can be readily pulled out of the dispenser (this avoids the nuisance of having the needles drop on the floor); (b) The B—B shot, by frictional contact with the needles, will serve to "polish"0 the surface of the needles and thereby eliminate the problem of corrosion and rust formation on the surface of the needles.

The needle dispenser of this invention may be fabricated from any desirable material. Preferably, it is fabricated by injection molding of a thermoplastic polymer, e.g. polystyrene, polypropylene, poly-methacrylates, etc. The dispenser may be fabricated as a unitary piece, but has been found to be most readily and economically fabricated in two pieces of substantially equal dimensions, which two pieces are adapted to sealingly mate with one another; the aperture may be molded in place or may be formed by drilling. From an economic point of view, it is preferable to fabricate the dispenser in two pieces, using the same mold. When the piece which will contain the aperture is to be molded, a mold pin of the appropriate diameter may be inserted in the mold prior to injection of the thermoplastic polymer. Further, it is desirable that the piece which contains the aperture be transparent (or at least a portion thereof be transparent) for visibility of the needles in the storage cavity; the other piece may be translucent or transparent as desired. When the dispenser is fabricated in two pieces, the two pieces may be mated to one another by conventional techniques, e.g. adhesives, solvent welding, sonic welding, heat welding, screw threads, etc.

Figure 1:
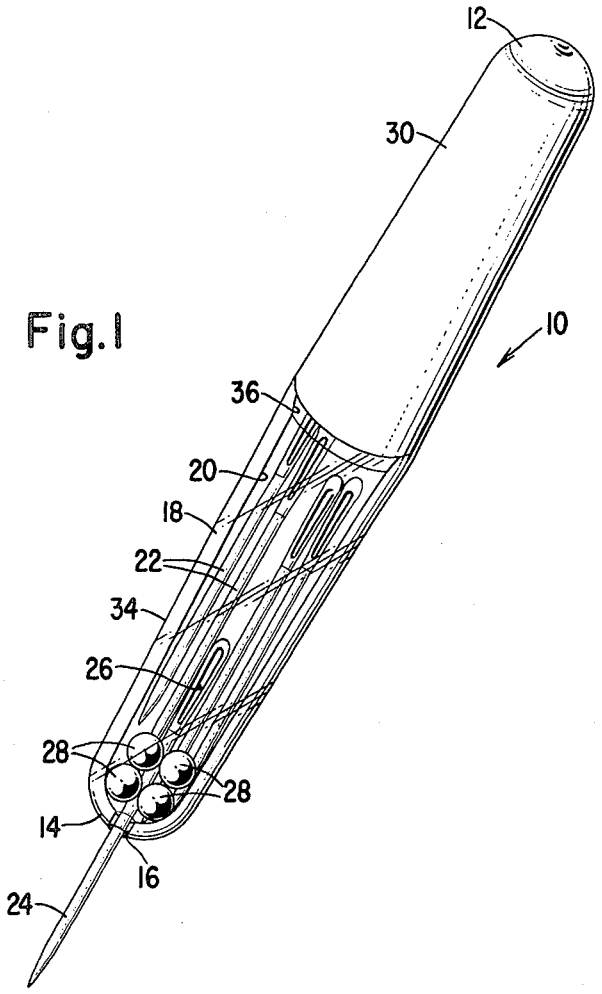
Figure 2:
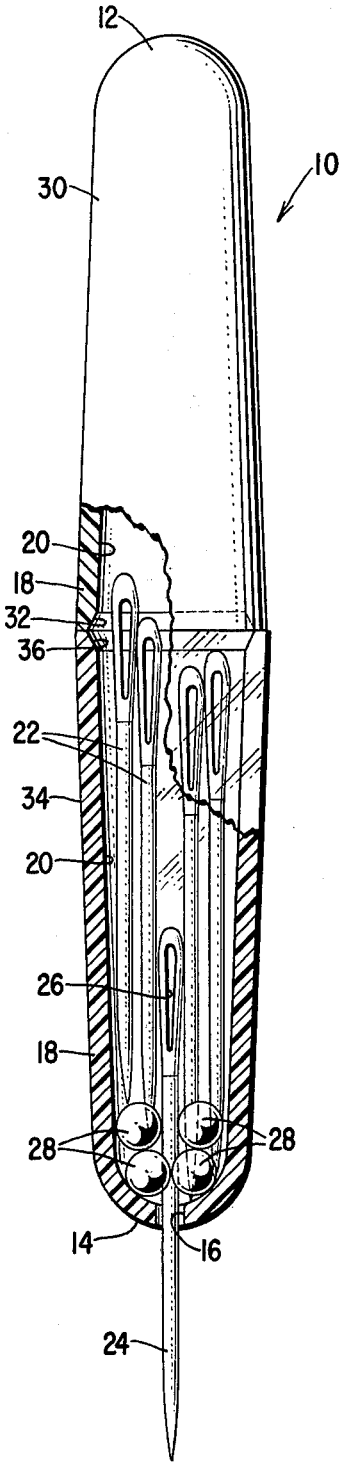

The needle dispenser of this invention may be more readily understood by reference to the accompanying drawings in which:

FIG. 1 is a perspective view, and FIG. 2 is an elevation view (partially in section), of the dispenser with needles in the storage cavity and one needle partially emerged therefrom through the aperture which communicates with the cavity.

Referring now in detail to FIG. 1 and FIG. 2 (in which like reference numerals refer to like features):

The dispenser comprises a tubular body 10 containing at its uppermost extremity sealed end 12 and at its lower-most extremity, convex surface 14 which in turn contains a substantially-centrally located aperture 16 which is substantially circular in configuration. Aperture 16 communicates with storage cavity 20 which in turn is defined by the walls 18 of body 10; a plurality of needles 22 may be stored in storage cavity 20.

Sealed end 12 may terminate in a convex surface as shown or may terminate in any other configuration as desired. However, in the preferable embodiment discussed below, it is economically desirable to fabricate body 10 in two pieces, an upper portion 30 and a lower portion 34, and to use the same mold for portions 30 and 34. Preferably, the body 10 contains a plurality (e.g. 3–5) of B—B shot 28 which are freely movable within cavity 20. As may be seen in FIGS. 1 and 2, a needle 24 having an eyelet 26 has partially (e.g. about one-half of its length) emerged from cavity 20 through aperture 16. For most needles, the eyelet 26 represents the maximum diameter of the needle. In any event, aperture 16 must have a diameter in excess of the maximum diameter of the greatest-diameter needle contained in cavity 20.

Preferably, cavity 20 will contain a maximum of up to about three-fourth of its volumetric area occupied by needles 22 which range from 1 to 5 consecutively graded sizes and aperture 16 may vary in diameter from about one one-hundredth to about one-twentith of an inch in excess of the maximum diameter of the greatest-diameter needle desired to be stored in cavity 20. It has been found that if more than about five consecutively-sized needles are stored in cavity 20 or if the sizes of the needles stored in cavity 20 are not consecutive, aperture 16 must have a diameter which will be so large as to possibly defeat the desired result of not allowing the needle 24 to freely drop completely out from cavity 20.

Routine trial-and-error will readily point out the most desirable minimum and maximum number of needles 22 (as well as their size variations) to be stored in cavity 20, the most desirable number of B—B shot 28 and the most desirable diameter of aperture 16 for such needles (of course, as shown in FIGS. 1 and 2, the needles 22 are loaded into cavity 20 with their maximum diameter, usually their eyelets 26, upward). A typical dispenser will contain approximately 4 #18 needles, 2 #20 needles, 4 B—B shot 28 and an aperture 16 having a diameter of about 0.076 inch; FIG. 1 and FIG. 2 are 1 1/2:1 and 2:1, respectively, scaled-up versions of a typical dispenser (this size dispenser will hold up to about 24 of the largest size needles and up to 48 of the smallest size needles).

As previously mentioned, it is economically desirable to fabricate body 10 in the form of 2 parts: upper part 30 and lower part 34; these parts may be conveniently injection-molded (e.g. from polystyrene) in the same mold, except that it is preferable to insert a mold pin in the mold to thereby form aperture 16 prior to molding part 34 (this technique for molding-in aperture 16 provides greater economies, and tighter tolerance control over the diameter of aperture 16 than by drilling).

As may be seen in FIGS. 1 and 2, wall 18 of part 34 preferably has a slight-inward taper towards convex surface 14 (the same is true for part 30 if it is molded from the same mold). The gentle taper, e.g. 1°–5°, offers the benefit of guiding the needles 22 toward aperture 16. Where parts 30 and 34 are molded in the same mold, they may be sealingly mated to one another by butting together at their respective open ends 32 and 36; in the case of polystyrene, parts 30 and 34 may be butt-sealed to one another with the aid of a solvent, e.g. methyl-ethyl ketone.

The needle dispenser of this invention may be readily filled with needles of the desired number and sizes by inserting the needles 22, eyelets 26 up into the storage cavity 20. Such insertion may be readily carried out through aperture 16 or, prior to mating of portions 30 and 34, however, if portions 30 and 34 are sealed by solvent welding, it is desirable to fill the dispenser through aperture 16 after the solvent has thoroughly dried in order to avoid adhesion of needles 22 to the walls 18 at the area of adhesion of portions 30 and 34. The needle dispenser is readily operable by grasping it (in either hand) with the thumb and one or more opposing fingers and thereafter twisting the wrist, in a moderately sharp movement, such that the dispenser is tilted from a plane parallel to the ground to that of an angle of about 30° to about 90° relative to the ground. Needle 24 which then partially emerges may be readily pulled out; if undue resistance to the extraction of needle 24 results, such resistance may be overcome by slightly tilting the dispenser backward (i.e. towards a parallel relationship to the plane of the ground), thereby causing B—B shot 28 to slide backward and to disengage their frictional contact with needle 24.

The dispenser of this invention may be sized to hold any number and size of needles (as mentioned above, it is preferable that not more than about 5 consecutively-sized needles be stored in the dispenser). As a guide in determining the appropriate size of the tubular body 10, storage cavity 20 and the diameter of aperture 16, the following table lists representative sizes and types of needles which may be utilized in this dispenser.

TABLE

| Type and Size | | Maximum Width | Length |
|---|---|---|---|
| Tapestry | #16 | 0.100 | 1-14/16 |
| | #18 | 0.074 | 1-12/16 |
| | #20 | 0.064 | 1-11/16 |
| | #22 | 0.050 | 1-9/16 |
| | #24 | 0.042 | 1-8/16 |
| Embroidery Crewel | #1 | 0.074 | 1-15/16 |
| | #2 | 0.068 | 1-21/32 |
| | #3 | 0.062 | 1-14/16 |
| | #4 | 0.056 | 1-19/32 |
| | #5 | 0.048 | 1-10/16 |
| | #6 | 0.043 | 1-17/32 |
| | #7 | 0.038 | 1-8/16 |
| | #8 | 0.034 | 1-6/16 |
| | #9 | 0.032 | 1-9/32 |
| | #10 | 0.030 | 1-5/16 |
| Darners | #1 | 0.072 | 2-4/16 |
| | #2 | 0.064 | 2-3/16 |
| | #3 | 0.056 | 2-2/16 |
| | #4 | 0.054 | 2-1/16 |
| | #5 | 0.052 | 2 |
| Sharps | #1 | 0.052 | 1-14/16 |
| | #2 | 0.045 | 1-25/32 |
| | #3 | 0.040 | 1-12/16 |
| | #4 | 0.036 | 1-21/36 |
| | #5 | 0.034 | 1-33/64 |
| | #6 | 0.032 | 1-8/16 |
| | #7 | 0.030 | 1-7/16 |
| | #8 | 0.029 | 1-11/32 |
| | #9 | 0.028 | 1-5/16 |
| | #10 | 0.027 | 1-9/32 |
| Between Quilting | #1 | 0.047 | 1-7/16 |
| | #2 | 0.043 | 1-13/32 |
| | #3 | 0.039 | 1-6/16 |

TABLE-continued

| Type and Size | | Maximum Width | Length |
|---|---|---|---|
| | #4 | 0.037 | 1-11/32 |
| | #5 | 0.035 | 1-5/16 |
| | #6 | 0.033 | 1-4/16 |
| | #7 | 0.031 | 1-3/16 |
| | #8 | 0.030 | 1-3/32 |
| | #9 | 0.028 | 1 |
| | #10 | 0.026 | 31/32 |

It is understood that the configurations, dimensions and techniques mentioned hereinabove are merely representative and that the scope of this invention is limited solely by the claims which follow.

What is claimed is:

1. A needle dispenser comprising a tubular body whose walls contain an inner and outer surface, said inner surface defining a cavity therein for storage of needles, said cavity containing a plurality of spherical pellets, said body terminating in a first end which is sealed at its extremity and terminating at a second end containing a centrally-located aperture in communication with said cavity, said aperture having a diameter in excess of the maximum diameter of the greatest-diameter needles to be stored in said cavity, said outer surface terminating at said second end in a substantially convex surface and said inner surface terminating at said second end in a substantially concave surface, such that when the dispenser is oriented in a dispensing position, at least some of said pellets will be in frictional contact with said substantially concave surface and with said needles, such that only one needle at a time is capable of being dispensed from said dispenser through said aperture.

2. The dispenser of claim 1 wherein the plurality of spherical pellets consist of 3 to 5 B—B shot.

3. The dispenser of claim 1 wherein a plurality of needles encompassing not more than about 5 consecutively-sequential sizes of the same type are stored in said cavity.

4. The dispenser of claim 1 wherein the diameter of the aperture ranges from about one one-hundredth to about one-twentieth of an inch in excess of said maximum diameter.

5. The dispenser of claim 1 wherein said body consists of an upper part and a lower part, said upper part terminating at its upper-most extremity in said first end and terminating at its opposite lower-most end in a first open end, and said lower part terminating at its lower-most end in said second end and terminating at its opposite, upper-most end in a second open end, said first open end and said second open end being adapted to sealingly mate with one another.

6. The dispenser of claim 5 wherein said body is injection-molded from a thermoplastic polymer and said first and second open ends are butt-mated to one another by solvent-adhesion.

7. The dispenser of claim 5 wherein said body is injection-molded from a thermoplastic polymer and said first and second open ends are butt-mated to one another by sonic welding.

8. The dispenser of claim 5 wherein the walls of said lower part taper inwardly from said second open end toward said second end.

9. The dispenser of claim 8 wherein the degree of taper ranges from about 1° to about 5°.

* * * * *